US011264731B2

(12) United States Patent
Zhu et al.

(10) Patent No.: US 11,264,731 B2
(45) Date of Patent: Mar. 1, 2022

(54) ANTENNA ARRAY AND WIRELESS COMMUNICATIONS DEVICE

(71) Applicant: HUAWEI TECHNOLOGIES CO., LTD., Guangdong (CN)

(72) Inventors: Maomao Zhu, Suzhou (CN); Bo Yuan, Suzhou (CN); Rui Hua, Suzhou (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 92 days.

(21) Appl. No.: 16/884,211

(22) Filed: May 27, 2020

(65) Prior Publication Data

US 2020/0287292 A1 Sep. 10, 2020

Related U.S. Application Data

(63) Continuation of application No. PCT/CN2018/118883, filed on Dec. 3, 2018.

(30) Foreign Application Priority Data

Dec. 6, 2017 (CN) ..... 201711278751.X

(51) Int. Cl.

| | |
|---|---|
| ***H01Q 21/06*** | (2006.01) |
| ***H01Q 19/13*** | (2006.01) |
| ***H01Q 1/38*** | (2006.01) |

(52) U.S. Cl.

CPC ..... *H01Q 21/062* (2013.01); *H01Q 1/38* (2013.01); *H01Q 19/13* (2013.01)

(58) Field of Classification Search

CPC ..... H01Q 3/24; H01Q 1/38; H01Q 21/20; H01Q 19/13; H01Q 19/30; H01Q 21/29; H01Q 21/062; H01Q 9/285

See application file for complete search history.

(56) References Cited

U.S. PATENT DOCUMENTS 2,287,550 A * 6/1942 Carter ..... H01Q 1/52 455/65
2,627,028 A * 1/1953 Nowak ..... H01Q 3/18 343/761

(Continued)

FOREIGN PATENT DOCUMENTS

CN 1599138 A 3/2005
CN 1747232 A 3/2006

(Continued)

*Primary Examiner* — Graham P Smith
*Assistant Examiner* — Jae K Kim

(57) ABSTRACT

An antenna array and a wireless communications device are disclosed. The antenna array includes at least two directional antennas in different directions. Each directional antenna includes an antenna element, a reflector, a feed line coupled to the antenna element, and a switch for controlling the feed line. The antenna element is a microstrip dipole antenna element. The reflector is a parasitic microstrip antenna element. A length of the reflector is greater than a length the antenna element. Two ends of the reflector are bent toward the antenna element. A distance between midpoints of reflectors of any two directional antennas is less than a distance between midpoints of antenna elements thereof. Because the reflectors of the antenna array are located on an inner side of a pattern enclosed by the antenna elements of directional antennas, a size of the antenna array is small.

17 Claims, 4 Drawing Sheets

(56) References Cited

U.S. PATENT DOCUMENTS

| | | | | |
|---|---|---|---|---|
| 2,875,438 | A * | 2/1959 | Hings | H01Q 19/30 343/733 |
| 4,611,214 | A * | 9/1986 | Campbell | H01Q 19/22 343/790 |
| 6,498,589 | B1 | 12/2002 | Horii | |
| 7,629,938 | B1 * | 12/2009 | Josypenko | H01Q 19/30 343/815 |
| 9,019,165 | B2 | 4/2015 | Shtrom et al. | |
| 9,799,963 | B2 | 10/2017 | Huang et al. | |
| 10,439,285 | B2 * | 10/2019 | Isik | H01Q 1/523 |
| 2006/0044200 | A1 | 3/2006 | Mori | |
| 2007/0152903 | A1 | 7/2007 | Lin et al. | |
| 2010/0053023 | A1 | 3/2010 | Shtrom et al. | |
| 2011/0063181 | A1 | 3/2011 | Walker | |
| 2011/0193761 | A1 | 8/2011 | Shinkai et al. | |
| 2014/0118191 | A1 | 5/2014 | Smith et al. | |
| 2016/0104941 | A1 * | 4/2016 | Lee | H01Q 1/1228 343/702 |
| 2017/0033471 | A1 | 2/2017 | Huang et al. | |
| 2019/0252800 | A1 * | 8/2019 | Yetisir | H01Q 21/065 |
| 2020/0144701 | A1 * | 5/2020 | Zimmerman | H01Q 1/36 |

FOREIGN PATENT DOCUMENTS

| | | | |
|---|---|---|---|
| CN | 1825704 | A | 8/2006 |
| CN | 202871960 | U | 4/2013 |
| CN | 204834891 | U | 12/2015 |
| CN | 105356041 | A | 2/2016 |
| CN | 205565000 | U | 9/2016 |
| CN | 106025529 | A | 10/2016 |
| CN | 106159464 | A | 11/2016 |
| CN | 205944449 | U | 2/2017 |
| CN | 107251318 | A | 10/2017 |
| EP | 1523062 | A1 | 4/2005 |
| JP | 2000269736 | A | 9/2000 |
| JP | 2002330024 | A | 11/2002 |
| JP | 2006060756 | A | 3/2006 |
| JP | 2006066993 | A | 3/2006 |
| JP | 2007158826 | A | 6/2007 |
| WO | 2010041436 | A1 | 4/2010 |

* cited by examiner

ANTENNA ARRAY AND WIRELESS COMMUNICATIONS DEVICE

CROSS-REFERENCE TO RELATED APPLICATIONS

This application is a continuation of International Application No. PCT/CN2018/118883, filed on Dec. 3, 2018, which claims priority to Chinese Patent Application No. 201711278751.X, filed on Dec. 6, 2017. The disclosures of the aforementioned applications are hereby incorporated by reference in their entireties.

TECHNICAL FIELD

This application relates to the communications field, and in particular, to an antenna array and a wireless communications device.

BACKGROUND

An anti-interference capability of an antenna may be improved by making an electromagnetic wave point to a particular direction. A smart antenna formed by a plurality of directional antennas pointing to different directions can change a radio receiving and sending direction of the antenna. Because a directional antenna has a large volume, it is difficult to miniaturize the smart antenna formed by the plurality of directional antennas pointing to different directions.

SUMMARY

This application provides an antenna array and a wireless communications device, to implement a miniaturized smart antenna.

According to a first aspect, an antenna array is provided, including a first directional antenna and a second directional antenna. The first directional antenna and the second directional antenna are in different directions. The first directional antenna includes a first antenna element, a first reflector, a first feed line coupled to the first antenna element, and a first switch for controlling the first feed line. The second directional antenna includes a second antenna element, a second reflector, a second feed line coupled to the second antenna element, and a second switch for controlling the second feed line. The first antenna element is a microstrip dipole antenna element. A length of the first antenna element is approximately a half of an operating wavelength of the antenna array. The first reflector is a parasitic microstrip antenna element. A length of the first reflector is slightly greater than the length of the first antenna element. A distance between a midpoint of the first reflector and the first antenna element is approximately a quarter of the operating wavelength. Two ends of the first reflector are bent toward the first antenna element. The second antenna element is a microstrip dipole antenna element. A length of the second antenna element is approximately a half of the operating wavelength. The second reflector is a parasitic microstrip antenna element. A length of the second reflector is slightly greater than the length of the second antenna element. A distance between a midpoint of the second reflector and the second antenna element is approximately a quarter of the operating wavelength. Two ends of the second reflector are bent toward the second antenna element. A distance between the midpoint of the first reflector and the midpoint of the second reflector is smaller than a distance between a midpoint of the first antenna element and a midpoint of the second antenna element.

The reflectors of the foregoing antenna array are located on an inner side of a pattern enclosed by antenna elements of directional antennas. Therefore, a size of the antenna array is small. Two ends of each reflector are bent toward an antenna element can prevent the reflectors located on the inner side of the pattern enclosed by the antenna elements from overlapping with each other.

With reference to the first aspect, in a first implementation of the first aspect, the antenna array further includes a first printed circuit board and a second printed circuit board. The first antenna element, the first feed line, the first switch, the second antenna element, the second feed line, and the second switch are disposed on the first printed circuit board. The first reflector and the second reflector are disposed on the second printed circuit board. The first printed circuit board is parallel to the second printed circuit board and is fastened to the second printed circuit board.

Because the feed lines are also on the inner side of the pattern enclosed by the antenna elements, to dispose the feed lines and the reflectors onto a printed circuit board, a design of the antenna array may be complex. The antenna array may be simplified by disposing the feed lines and the reflectors onto different printed circuit boards.

With reference to the first aspect or the first implementation of the first aspect, in a second implementation of the first aspect, the length of the first reflector is approximately 0.54 to 0.6 times the operating wavelength. The length of the second reflector is approximately 0.54 to 0.6 times the operating wavelength.

With reference to the first aspect, the first implementation of the first aspect, or the second implementation of the first aspect, in a third implementation of the first aspect, the first switch and the first switch are PIN diodes.

According to a second aspect, a wireless communications device is provided, including the antenna array in the foregoing first aspect or any one of the first implementation to the third implementation of the first aspect. The wireless communications device further includes a control circuit. The control circuit is configured to switch off the first switch or the second switch to control the antenna array to be in a directional mode.

With reference to the second aspect, in a first implementation of the second aspect, the control circuit is further configured to switch on the first switch and the second switch to control the antenna array to be in an omnidirectional mode.

DESCRIPTION OF EMBODIMENTS

The following describes embodiments of the present disclosure with reference to FIG. 1 to FIG. 4.

Figure 1:
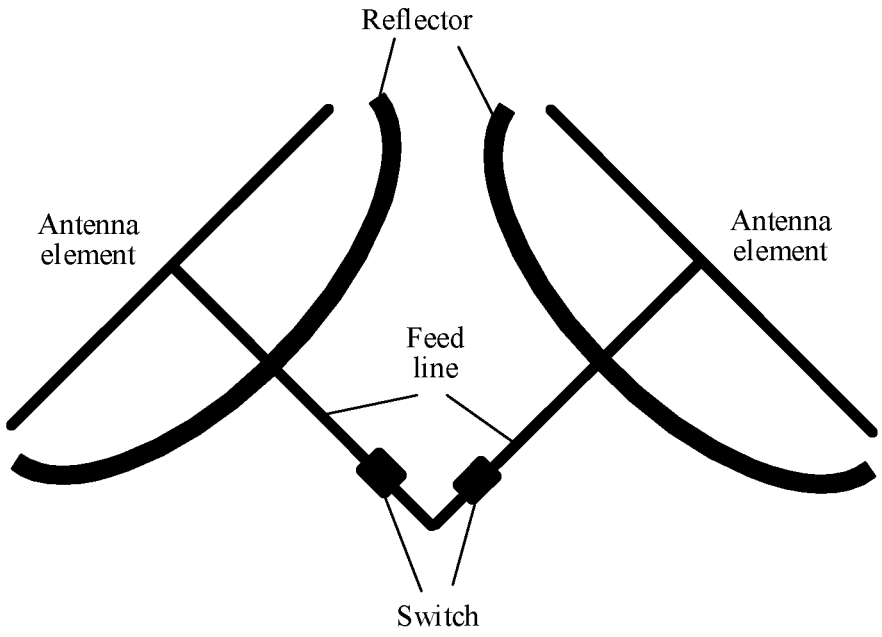
FIG. 1 is a schematic diagram of an antenna array including two directional antennas according to an embodiment of the present disclosure.
Figure 2:
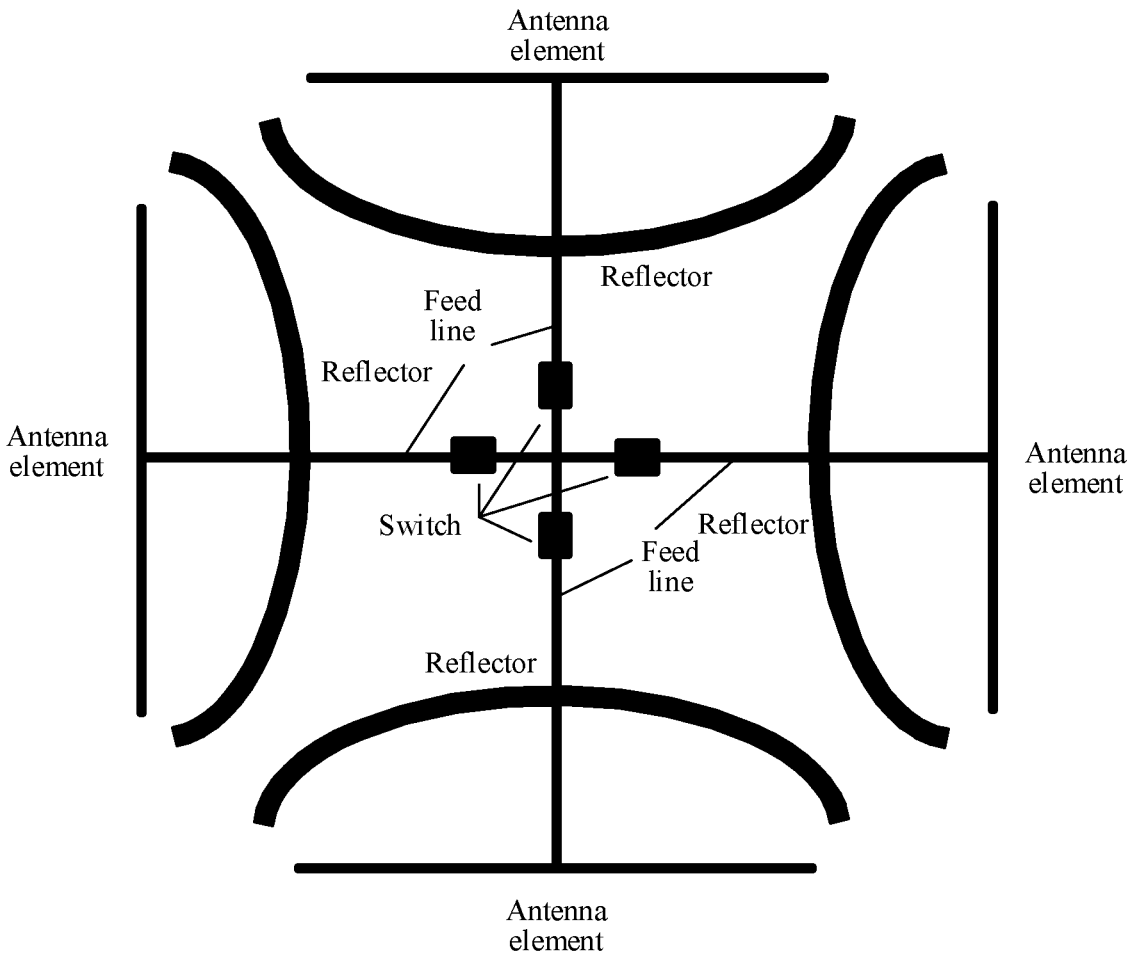
FIG. 2 is a schematic diagram of an antenna array including four directional antennas according to an embodiment of the present disclosure.
Figure 3:
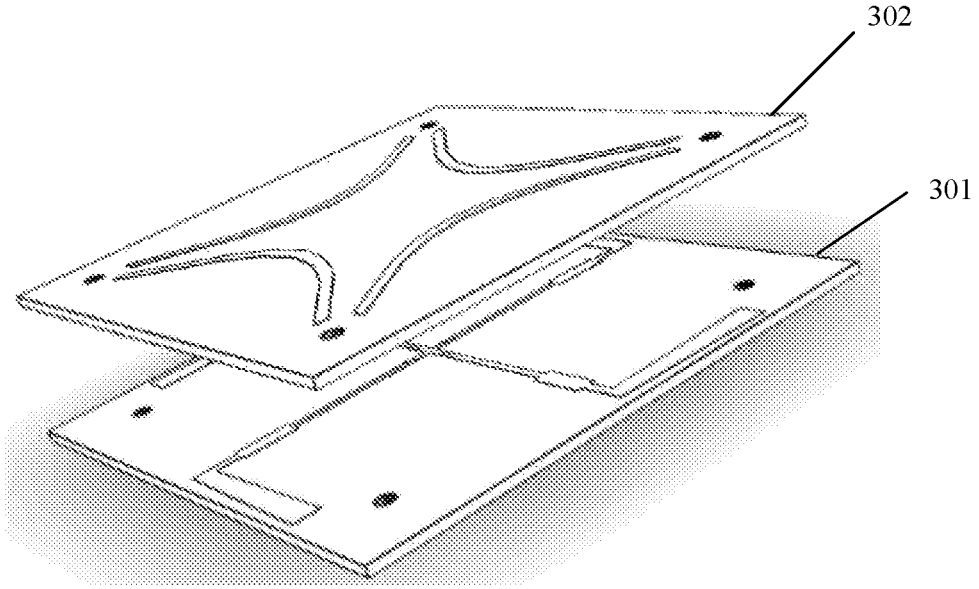
FIG. 3 is a schematic diagram of an antenna array in which a feed line and a reflector are disposed on different printed circuit boards according to an embodiment of the present disclosure.

FIG. 1 to FIG. 3 are schematic diagrams of an antenna array according to an embodiment of the present disclosure. The antenna array includes at least two directional antennas. The directional antennas are in different directions. For example, as shown in FIG. 1, the antenna array includes two directional antennas, the directional antenna on a left side points to the front left, and the directional antenna on a right side points to the front right. For another example, as shown in FIG. 2, the antenna array includes four directional antennas, the directional antenna on the left side points to the left, and the directional antenna on the right side points to the right, a front directional antenna points to the front, and a back directional antenna points to the back. A quantity of directional antennas included in the antenna array may be 3, 5, 6, or more. All directional antennas are arranged in a centrosymmetric manner and point to an outer side.

Each directional antenna in the directional antennas includes an antenna element, a reflector, a feed line (English: feed line) coupled to the antenna element, and a switch for controlling the feed line. To reduce a size of the antenna array, the directional antenna is a microstrip antenna. The feed line may be a double-sided parallel-strip line (English: double-sided parallel-strip line). The switch may be a PIN diode.

To reduce the size of the antenna array, the antenna element is a microstrip dipole antenna element. The antenna element is coupled to the feed line, and therefore, is a driven element (English: driven element). A length of the antenna element is approximately a half of an operating wavelength (English: operating wavelength) of the antenna array. The operating wavelength is a wavelength of an electromagnetic wave corresponding to a center frequency of an operating band (English: operating band) of the antenna array, and is also referred as λ below. λ is a wavelength in a medium, and is related to a dielectric constant. When an antenna is printed on a surface of the medium, a dielectric constant corresponding to λ is correlated to both the dielectric constant of the medium and the dielectric constant of air. For example, the dielectric constant corresponding to λ is an average value of the dielectric constant of the medium and the dielectric constant of air. For example, when the antenna is printed on a surface of a medium having a dielectric constant of 4.4, the dielectric constant corresponding to λ is approximately (4.4+1)/2=2.7. The operating band of the antenna is a range and may include a plurality of channels, and the length of the antenna element is a fixed value and does not allow the antenna element to achieve optimum resonance of an electromagnetic wave at an operating frequency. Therefore, the length of the antenna element does not need to accurately be ½λ. The length of the antenna element only needs to be close to ½λ, and for example, ranges from approximately 0.44λ to 0.53λ.

To reduce the size of the antenna array, the reflector is a parasitic (English: parasitic) microstrip antenna element. A length of the reflector is slightly greater than the length of the antenna element, and for example, ranges from approximately 0.54λ to 0.6λ A distance between a midpoint of the reflector and the antenna element is approximately ¼λ. Because the length of the reflector is slightly greater than the length of the antenna element, the reflector has inductive reactance, which means that a phase of a current of the reflector lags behind a phase of an open circuit voltage caused by a received field. Electromagnetic waves emitted by the reflector and the antenna element constructively interfere with each other in a forward direction (a direction from the reflector to the antenna element) and destructively interfere with each other in a reverse direction (a direction from the antenna element to the reflector). Therefore, electromagnetic waves emitted by a combination of the antenna element and the reflector point to the direction from the reflector to the antenna element.

To reduce the size of the antenna array, all reflectors are located on an inner side of a pattern enclosed by antenna elements of directional antennas. Therefore, a distance between midpoints of two reflectors is less than a distance between midpoints of two corresponding antenna elements. However, because the reflector is longer than the antenna element, the reflectors may overlap with each other when the reflectors are disposed on the inner side of the pattern enclosed by the antenna elements. To prevent the reflectors from affecting each other, two ends of the reflector are bent toward the antenna element to prevent the reflectors from overlapping with each other.

A size of an antenna array using the foregoing structure is small. For example, a size of a four-directional antenna array shown in FIG. 2 whose operating band is 2.4 gigahertz (GHz) can be reduced to 56 millimetre (mm)*56 mm.

Because the feed lines are also on the inner side of the pattern enclosed by the antenna elements, to dispose the feed lines and the reflectors onto a printed circuit board (PCB), a design of the antenna array may be complex. To simplify the antenna array, a feed line and a reflector may be disposed onto different PCBs. Referring to FIG. 3, an antenna array using the structure includes two PCBs, namely, a first PCB 301 and a second PCB 302. The first PCB 301 and the second PCB 302 are disposed in an overlapped manner, that is, the first PCB 301 and the second PCB 302 are parallel to each other, and projections of the first PCB 301 and the second PCB 302 overlap. The first PCB 301 is fastened to the second PCB 302. For example, holes are provided at positions that are parallel to each other and that correspond to each other in the first PCB 301 and the second PCB 302, and a fastener (for example, a plastic screw, a plastic stand-off, or a spacer support (English: spacer support)) passing through the corresponding holes is used to fasten the first PCB 301 and the second PCB 302. Because the feed line is coupled to the antenna element, the antenna element, the feed line, and the switch of each directional antenna are disposed on the first PCB 301, and the reflector of each directional antenna is disposed on the second PCB 302. FIG. 3 only shows one side of the first PCB 301, and one arm of the microstrip dipole antenna element is disposed on the side, another arm of the microstrip dipole antenna element is disposed on the other side of the first PCB. The second PCB 302 in FIG. 3 is above the first PCB 301. The second PCB 302 may alternatively be below the first PCB.

Figure 4:
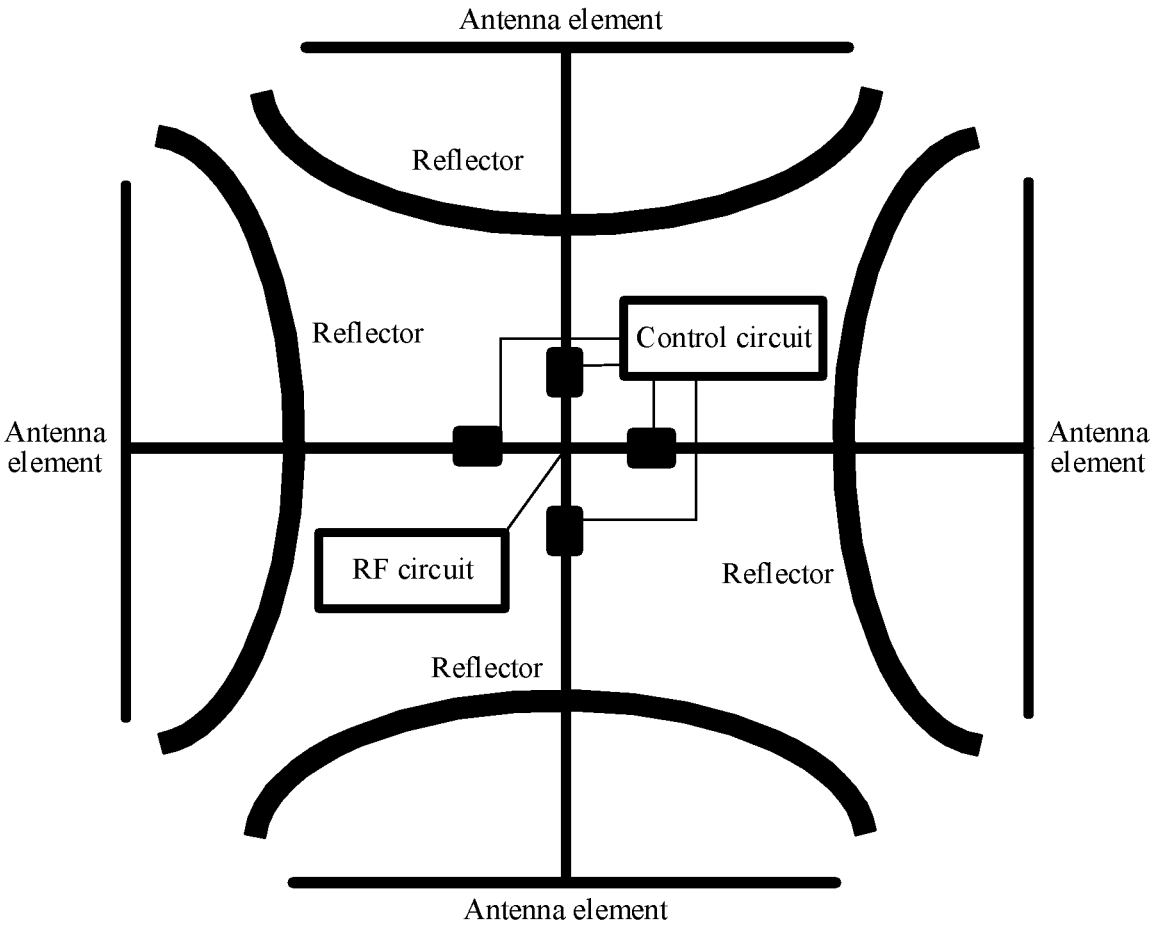
FIG. 4 is a schematic diagram of a wireless communications device according to an embodiment of the present disclosure.

FIG. 4 is a schematic diagram of a wireless communications device according to an embodiment of the present disclosure. The wireless communications device includes a control circuit and the antenna array in the embodiments shown in FIG. 1 to FIG. 3. The control circuit can switch off a switch or switches of one or some of the directional antennas, to control the antenna array to be in a directional mode. The control circuit can further switch on switches of all directional antennas, to control the antenna array to be in an omnidirectional mode. If each switch is a PIN diode, the control circuit may apply a forward bias (English: forward bias) to a to-be-switched-on switch, to switch on the switch. The wireless communications device further includes a radio frequency (RF) circuit coupled to the feed lines. The RF circuit is further referred to as an RF module, and is configured to receive and send an RF signal. The control circuit may be integrated in the RF circuit, or may be another device. For example, the control circuit may be a complex programmable logic device (English: complex programmable logic device, CPLD), a field programmable gate array (FPGA), a central processing unit (CPU), or any combination thereof.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. An antenna array, comprising:

a first directional antenna; and a second directional antenna coupled to the first directional antenna, wherein the first directional antenna and the second directional antenna point to different directions, wherein the first directional antenna comprises a first antenna element, a first reflector, a first feed line coupled to the first antenna element, and a first switch coupled to the first feed line for controlling the first feed line, wherein the second directional antenna comprises a second antenna element, a second reflector, a second feed line coupled to the second antenna element, and a second switch coupled to the second feed line for controlling the second feed line, wherein the first antenna element is a microstrip dipole antenna element, and a length of the first antenna element is approximately a half of an operating wavelength of the antenna array, wherein the first reflector is a parasitic microstrip antenna element, a length of the first reflector is greater than the length of the first antenna element, a distance between a midpoint of the first reflector and the first antenna element is approximately a quarter of the operating wavelength, and two ends of the first reflector are bent toward the first antenna element, wherein the second antenna element is a microstrip dipole antenna element, and a length of the second antenna element is approximately a half of the operating wavelength, wherein the second reflector is a parasitic microstrip antenna element, a length of the second reflector is greater than the length of the second antenna element, a distance between a midpoint of the second reflector and the second antenna element is approximately a quarter of the operating wavelength, and two ends of the second reflector are bent toward the second antenna element, and wherein a distance between the midpoint of the first reflector and the midpoint of the second reflector is smaller than a distance between a midpoint of the first antenna element and a midpoint of the second antenna element.

2. The antenna array according to claim 1, wherein the antenna array further comprises a first printed circuit board and a second printed circuit board, wherein the first antenna element, the first feed line, the first switch, the second antenna element, the second feed line, and the second switch are disposed on the first printed circuit board, wherein the first reflector and the second reflector are disposed on the second printed circuit board, and wherein the first printed circuit board is parallel to the second printed circuit board and is fastened to the second printed circuit board.

3. The antenna array according to claim 1, wherein the length of the first reflector is 0.54 to 0.6 times the operating wavelength, and the length of the second reflector is 0.54 to 0.6 times the operating wavelength.

4. The antenna array according to claim 2, wherein the length of the first reflector is 0.54 to 0.6 times the operating wavelength, and the length of the second reflector is 0.54 to 0.6 times the operating wavelength.

5. The antenna array according to claim 1, wherein the first switch and the first switch are PIN diodes.

6. The antenna array according to claim 2, wherein the first switch and the first switch are PIN diodes.

7. The antenna array according to claim 3, wherein the first switch and the first switch are PIN diodes.

8. The antenna array according to claim 4, wherein the first switch and the first switch are PIN diodes.

9. A wireless communications device, comprising:

a control circuit; and an antenna array coupled to the control circuit, wherein the antenna array comprises a first directional antenna and a second directional antenna coupled to the first directional antenna, wherein the first directional antenna and the second directional antenna points to different directions, wherein the first directional antenna comprises a first antenna element, a first reflector, a first feed line coupled to the first antenna element, and a first switch coupled to the first feed line for controlling the first feed line, wherein the second directional antenna comprises a second antenna element, a second reflector, a second feed line coupled to the second antenna element, and a second switch coupled to the second feed line for controlling the second feed line, wherein the first antenna element is a microstrip dipole antenna element, and a length of the first antenna element is approximately a half of an operating wavelength of the antenna array, wherein the first reflector is a parasitic microstrip antenna element, a length of the first reflector is greater than the length of the first antenna element, a distance between a midpoint of the first reflector and the first antenna element is approximately a quarter of the operating wavelength, and two ends of the first reflector are bent toward the first antenna element, wherein the second antenna element is a microstrip dipole antenna element, and a length of the second antenna element is approximately a half of the operating wavelength, wherein the second reflector is a parasitic microstrip antenna element, a length of the second reflector is greater than the length of the second antenna element, a distance between a midpoint of the second reflector and the second antenna element is approximately a quarter of the operating wavelength, and two ends of the second reflector are bent toward the second antenna element, wherein a distance between the midpoint of the first reflector and the midpoint of the second reflector is smaller than a distance between a midpoint of the first antenna element and a midpoint of the second antenna element, and wherein the control circuit is configured to switch off the first switch or the second switch to control the antenna array to be in a directional mode.

10. The wireless communications device according to claim 9, wherein the control circuit is further configured to switch on the first switch and the second switch to control the antenna array to be in an omnidirectional mode.

11. The wireless communications device according to claim 9, wherein the antenna array further comprises a first printed circuit board and a second printed circuit board, wherein the first antenna element, the first feed line, the first switch, the second antenna element, the second feed line, and the second switch are disposed on the first printed circuit board, wherein the first reflector and the second reflector are disposed on the second printed circuit board, and wherein the first printed circuit board is parallel to the second printed circuit board and is fastened to the second printed circuit board.

12. The wireless communications device according to claim 9, wherein the length of the first reflector is 0.54 to 0.6 times the operating wavelength, and the length of the second reflector is 0.54 to 0.6 times the operating wavelength.

13. The wireless communications device according to claim 11, wherein the length of the first reflector is 0.54 to 0.6 times the operating wavelength, and the length of the second reflector is 0.54 to 0.6 times the operating wavelength.

14. The wireless communications device according to claim 9, wherein the first switch and the first switch are PIN diodes.

15. The wireless communications device according to claim 11, wherein the first switch and the first switch are PIN diodes.

16. The wireless communications device according to claim 12, wherein the first switch and the first switch are PIN diodes.

17. The wireless communications device according to claim 13, wherein the first switch and the first switch are PIN diodes.

* * * * *